US006886530B2

(12) United States Patent
Matischok et al.

(10) Patent No.: US 6,886,530 B2
(45) Date of Patent: May 3, 2005

(54) METHOD AND DEVICE FOR OPERATING A DRIVE ENGINE OF A VEHICLE

(75) Inventors: Lilian Matischok, Stuttgart (DE); Juergen Biester, Boeblingen (DE); Holger Jessen, Ludwigsburg (DE); Thomas Schuster, Brackenheim (DE); Rainer Mayer, Weil der Stadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/484,254

(22) PCT Filed: Jun. 14, 2002

(86) PCT No.: PCT/DE02/02173

§ 371 (c)(1),
(2), (4) Date: Jan. 20, 2004

(87) PCT Pub. No.: WO03/008789

PCT Pub. Date: Jan. 30, 2003

(65) Prior Publication Data

US 2004/0187841 A1 Sep. 30, 2004

(30) Foreign Application Priority Data

Jul. 19, 2001 (DE) ..... 101 035 0078

(51) Int. Cl.[7] ..... F02D 7/00

(52) U.S. Cl. ..... 123/395; 123/319

(58) Field of Search ..... 123/319, 395, 123/396, 399, 400

(56) References Cited

U.S. PATENT DOCUMENTS

| | | | | |
|---|---|---|---|---|
| 5,558,178 A | | 9/1996 | Hess et al. | |
| 5,921,219 A | | 7/1999 | Zhang et al. | |
| 6,065,446 A | * | 5/2000 | Engl et al. | 123/325 |
| 6,223,721 B1 | * | 5/2001 | Bauer et al. | 123/399 |

FOREIGN PATENT DOCUMENTS

| | | |
|---|---|---|
| DE | 196 12 455 | 10/1997 |
| DE | 197 39 567 | 3/1999 |
| DE | 199 47 052 | 5/2001 |

* cited by examiner

*Primary Examiner*—Bibhu Mohanty
(74) *Attorney, Agent, or Firm*—Walter Ottesen

(57) ABSTRACT

A method and an arrangement for operating a drive motor of a vehicle are suggested. A resulting desired torque for controlling the drive motor is pregiven in dependence upon the driver command torque and additional desired torque quantities. To limit the resulting desired torque, a motor minimum torque is provided which is derived from the lost torques and is dependent upon rpm.

10 Claims, 3 Drawing Sheets

METHOD AND DEVICE FOR OPERATING A DRIVE ENGINE OF A VEHICLE

FIELD OF THE INVENTION

The invention relates to a method and an arrangement for operating a drive motor of a vehicle.

BACKGROUND OF THE INVENTION

Electronic control systems are utilized for operating drive motors for vehicles. With the aid of the electronic control systems, the adjustable power parameter(s) of the drive motor is (are) determined in dependence upon input quantities. Some of these electronic control systems operate on the basis of a torque structure, that is, torque values are pregiven as desired values for the control system by the driver and, if required, from other control systems such as road speed controllers, electronic stability programs, transmission controls, et cetera. These torque values are converted by the control systems while considering additional operating variables into adjusting quantities for the power parameter(s) of the drive motor. An example for such a torque structure is known from DE 42 39 711 A1 (U.S. Pat. No. 5,558,178).

As described by way of example in this state of the art, the external interventions operate to reduce torque. In the extreme case, such an external intervention can reduce the rpm of the drive motor so much that the drive motor stalls. An example for a solution which prevents such a stalling is set forth in DE 197 39 567 A1. There, the output signal of the idle control is directly superposed on the driver command torque pregiven as an indicated engine torque. The driver command torque additionally contains the lost torques from internal motor friction and required torques of the ancillary equipment. The driver command torque can, in this way, not be less than zero. If a torque reduction occurs because of other control systems (for example, transmission, stability control), then a stalling of the engine is avoided because this external intervention in the subsequent coupling of the desired torques (torque coordination) can no longer intervene because of the high driver command torque. In lieu of this external intervention, the driver command torque becomes effective which is increased by lost torque and idle controller component. This solution is adapted specifically to the conditions in the control of a spark-ignition engine and can neither be applied in a simple manner to other drive types nor to other torque structures, for example, to structures which form the driver command at the wheel torque level.

SUMMARY OF THE INVENTION

With the input of a motor minimum torque (which is considered in the context of the torque coordination), a common (identical) base structure for coordinating torque influencing interventions can be given for various drive types, for example, for spark-ignition engines, diesel engines or also electric motors.

In an advantageous manner, the idle controller in one such common base structure is configured as a superposition onto the resulting desired torque, which is formed in the coordination, and various idle controller concepts can be integrated. Accordingly, and by way of example, an idle controller concept, which is typical for a spark-ignition engine, and which idle controller concept has a precontrol, a limited actuating time dynamic and a limited actuating range, can be integrated as can an idle controller concept in a diesel engine without precontrol having a short actuating time and an unlimited actuating range.

In an especially advantageous manner, the minimum torque to which the resulting desired torque is limited is dependent upon the rpm. In this way, a superposition point of the superposed idle controller torque is pregiven which considers whether, in the particular rpm-dependent operating point, the idle controller has priority over the other interventions or not. In the lower rpm range, the idle controller always has the priority for interventions so that stalling is avoided when there are active external interventions.

In an especially advantageous manner, the resulting desired torque, which is formed in the torque coordination, is limited to a defined lower value which corresponds to that desired torque which can be realized without stalling at the instantaneous operating point. If the minimum torque is so selected that it corresponds to the driver command at the wheel torque level for a released pedal and the instantaneous rpm then, in addition, a lost motion in the pedal is avoided in an advantageous manner.

Additional advantages will become apparent from the subsequent description of the embodiments and from the dependent patent claims.

BRIEF DESCRIPTION OF THE DRAWINGS

The invention will be explained in greater detail hereinafter with respect to the embodiments shown in the drawing.

DESCRIPTION OF THE PREFERRED EMBODIMENTS OF THE INVENTION

Figure 1:
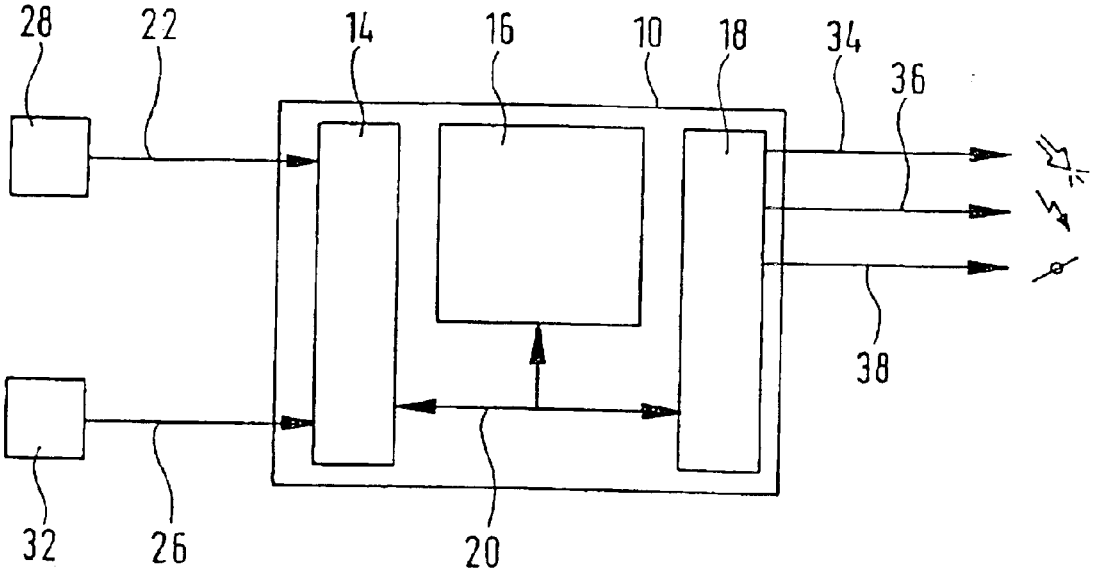
FIG. 1 shows an overview of a control arrangement for operating a drive motor while a preferred embodiment of a torque structure in combination with the control of a drive motor is shown in FIG. 2 with respect to a flowchart insofar as it is pertinent with a view to the described procedure.

FIG. 1 shows a block circuit diagram of a control arrangement for controlling a drive motor, especially, an internal combustion engine. A control unit 10 is provided which has the following components: an input circuit 14, at least one computer unit 16 and an output circuit 18. A communication system 20 connects these components for mutual data exchange. Input lines 22 to 26 lead to the input circuit 14 of the control unit 10. These input lines are configured as a bus system in a preferred embodiment and signals are supplied to the control unit 10 via these input lines. The signals represent operating variables which are to be evaluated for controlling the drive motor. These signals are detected by measuring devices 28 to 32. In the example of an internal combustion engine, operating variables of this kind are: accelerator pedal position, engine rpm, engine load, exhaust-gas composition, engine temperature et cetera. The control unit 10 controls the power of the drive motor via the output circuit 18. This is symbolized in FIG. 1 by the output lines 34, 36 and 38 via which the following are actuated: the fuel mass to be injected; the ignition angle as well as at least one electrically actuable throttle flap for adjusting the air supply. The following are adjusted via the illustrated actuating paths: the air supply to the internal combustion engine; the ignition angle of the individual cylinders; the fuel mass to be injected; the injection time point and/or the air/fuel ratio, et cetera. In addition to the described input quantities, additional control systems of the vehicle are provided which transmit input quantities such as torque desired values to the input circuit 14. Control systems of this kind are, for example: drive slip controls, vehicle dynamic controls, transmission controls, engine drag-torque controls, cruise control systems, speed limiters, et cetera. In addition to these external desired value inputs (to which also a desired value input by the driver can belong in the form of a driver command or a maximum speed limiting), there are internal input quantities for the drive motor provided, for example, the output signal of an idle control, an rpm limitation, a torque limitation, et cetera.

In the torque coordination, the various torque input values (such as the driver command torque, desired torque of a stability controller, desired torque of a transmission control as well as, if required, internal desired torques, et cetera) are coordinated with each other and a resulting desired torque is selected. Idle controller and lost torque are then considered by superposition on the desired torque resulting from the coordination. The lost torque can, and depending upon the controller concept for active idle control, be contained in the desired torque or change torque of the idle controller or is added as an inherent addition quantity also for an active idle controller.

As described above, and especially in the lower rpm range, wherein the reliable idle operation and the avoidance of stalling is of great significance, the resulting desired torque is limited downwardly by a motor minimum torque which is preferably a clutch torque at the motor output and which is zero in this rpm range. Accordingly, and also for external interventions, the same superposition point applies for the idle controller and/or the superposition of the lost torques as this torque occurs when there is an omitted driver command (released pedal). This is also the case when the external intervention requests a desired torque which is less than the lost torque and/or the idle correction. This affords the advantage that losses can be completely compensated and the idle controller has priority over other interventions so that stalling is effectively avoided.

In the upper rpm range, overrun operation is permissible, that is, a part compensation of the losses and a suppression of injection is permissible. In this case, the idle controller requires no intervention, that is, the idle controller is inactive. In a preferred embodiment, the minimum engine torque is the lost torque component which need not be compensated in overrun. The torque limiting cannot be less than the negative total lost torque. In the event that, in this range, the minimum torque is requested, it is achieved that losses are only partially compensated or not compensated by the superposition of the total lost torque. In order to avoid dead travel, the minimum torque preferably corresponds to the torque which is computed as driver command torque (wheel torque or transmission output torque) for a released pedal and, if needed, the instantaneous rpm.

Figure 2:
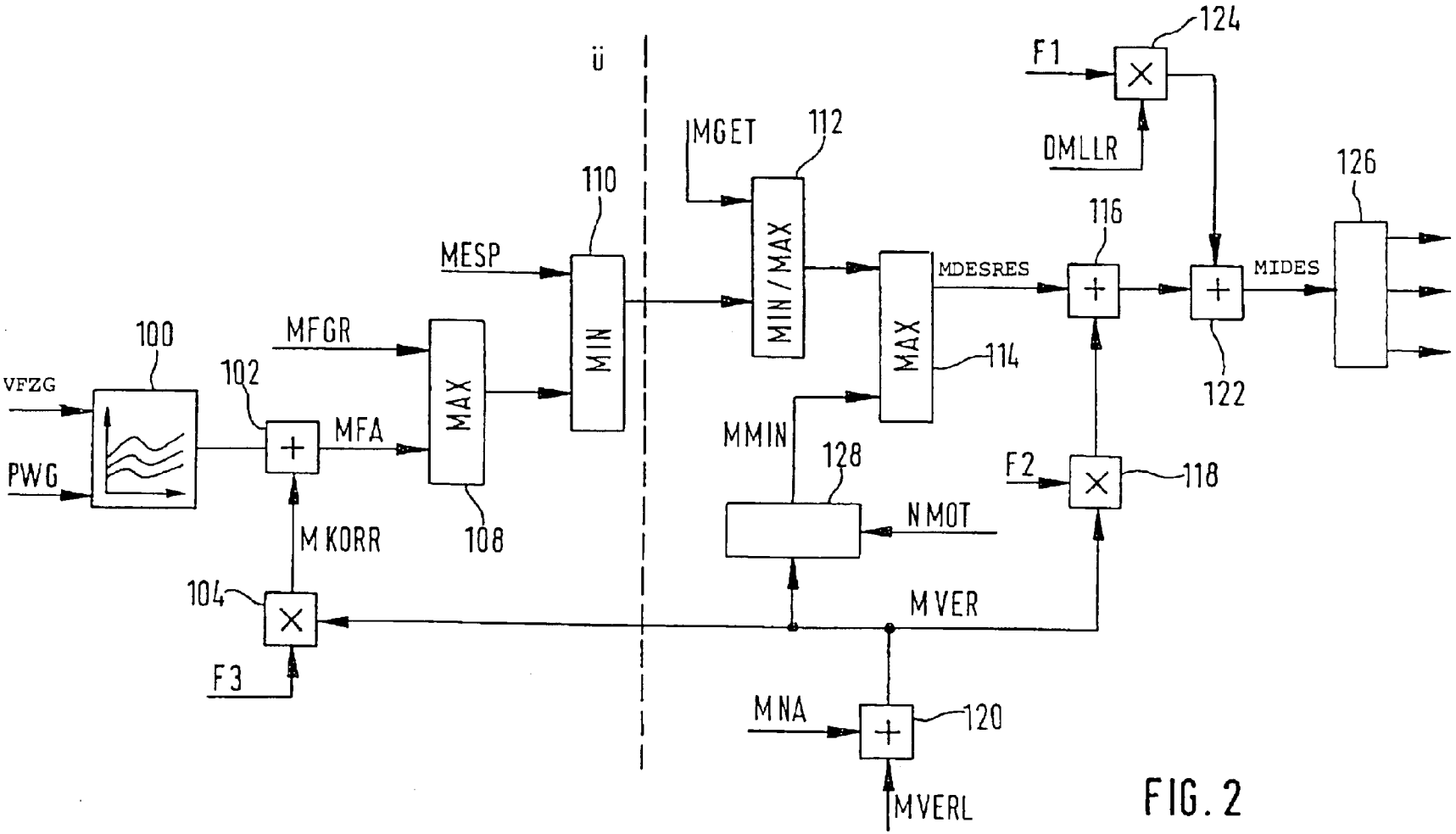

The flowchart, which is shown in FIG. 2, describes a program of a microcomputer of the control unit 10. The individual blocks show programs, program parts or program steps while the connecting lines represent the signal flow. The first part up to the perpendicular broken line can run in another control unit (and there also in a microcomputer) than the part after this line.

First, signals are supplied which correspond to the vehicle speed VFZG as well as the accelerator pedal position PWG. These quantities are converted into a torque command of the driver in a characteristic field 100. This driver command torque defines an input quantity for a torque at the output end of the transmission or for the wheel torque. This driver command torque is supplied to a corrective stage 102. This correction is preferably an addition or subtraction. The driver command torque is corrected by a weighted lost torque MKORR which was formed in the logic element 104. In logic element 104, the supplied lost torque MVER is weighted with a factor F3. The lost torque MVER is converted by means of the transmission ratio Ü of the drive train as well as additional transmission ratios in the drive train as required at the output end of the transmission to a torque after the transmission, preferably, a wheel torque. The weighting preferably takes place as multiplication. The factor F3 is formed from the quantity, which represents the accelerator pedal position, and in one embodiment, a quantity representing the engine rpm or the factor F3 is configured exclusively in dependence upon the accelerator pedal position.

The driver command MFA formed in this manner is supplied to the torque coordination for forming a resulting input torque MDESRES. In the embodiment shown, the maximum value is selected in a first maximum value selection stage 108 from driver command MFA and input torque MFGR of a cruise control system. This maximum value is supplied to a follow-on minimum value stage 110 wherein the lesser value is selected from this value and the desired torque value MESP of an electronic stability program. The output quantity of the minimum value stage 110 defines a torque quantity at the output end of the transmission or a wheel torque quantity which is converted into a torque quantity at the output end of the transmission by considering the transmission ratio Ü as well as other transmission ratios, as required, in the drive train. This torque quantity is present at the output end of the transmission or at the output end of the drive motor. This torque quantity is coordinated in a further coordinator 112 with the desired torque MGETR of a transmission control. The desired torque of the transmission control is formed in accordance with the requirements of the shift operation. In the next maximum value selection stage 114, the resulting desired torque MDESRES is formed as the greater of the torque values motor minimum torque MMIN and the output torque of the coordination stage 112.

This torque coordination is exemplary. In other embodiments, the one or the other input torque is not applied for coordination, that is, there are additional input torques provided such as a torque of a maximum speed limiting, of an engine rpm limiting, a torque limiting, et cetera.

The resulting desired torque MDESRES is formed in the manner described above and is supplied to a corrective stage 116 wherein the desired torque is corrected by the lost torques, which are to be developed by the engine and are not available to the drive. The lost torques MVER are weighted with a factor F2 as required in a weighting stage 118. This factor F2 is constant or is dependent upon an operating variable such as engine rpm. The lost torques MVER themselves are formed in the addition stage 120 from the torque requirement MNA of ancillary equipment and from the engine lost torque MVERL. The determination of these quantities is known from the state of the art. The torque requirement is determined in dependence upon the operating state of the particular ancillary equipment in accordance with characteristic lines or the like and the engine lost torques are determined in dependence upon engine rpm and engine temperature in accordance with characteristic lines. The lost torque MVER, which is formed in this manner, is then made available to the correction stage 104. A conversion of the lost torque takes place with the aid of the known transmission ratio Ü as well as additional transmission ratios, as required, in the output train at the output end of the transmission to the level of the transmission output torque or wheel torque.

The output quantity of the corrective stage 116, which defines an addition in the preferred embodiment, is an input quantity for: the torque, which is to be generated by the drive unit for the drive (indicated engine torque); overcoming the inner losses; and, operating ancillary equipment (such as a climate control compressor). This input torque is corrected in a further corrective stage 122 with the output quantity DMLLR of the idle controller (preferably added) with the output quantity DMLLR being weighted in a corrective stage 124. The weighting factor F1, with which the output quantity of the idle controller is weighted in 124, is rpm dependent and/or time dependent. When moving out of the idle range, the factor decreases as a function of time or with increasing engine rpm to zero. The input quantity MIDES is converted in 126, as known from the state of the art, into actuating quantities for adjusting the power parameters of the drive unit. In the case of a spark-ignition engine, the power parameters are the air supply, fuel injection and ignition angle and, in the case of a diesel engine, the power parameters are the fuel quantity, et cetera.

The described procedure was shown above in combination with the application to internal combustion engines. In the same way, the procedure is applied also to electric motors. There, the indicated torque is the torque, which is to be developed by the drive motor for the drive, for the operation of ancillary equipment and for overcoming the internal friction.

In the maximum value selection stage 114, the greater of the supplied values, namely, the desired torque value (which is formed in 112) and the engine minimum torque MMIN, is selected as the resulting desired torque. An intervention which inputs a torque which is less than the engine minimum torque has thereby no effect or its effect is limited to the engine minimum torque. In the idle control range in which a superposition of the driver delay command onto the driver command does not take place in 102, the engine minimum torque is preferably zero so that, in 116 and 122, lost torques and idle controller torques can be superposed unhindered on this torque value corresponding to the driver command. In contrast, during overrun operation, the lost torque, which is superposed in 116 on the resulting desired torque, is partially or entirely compensated depending upon the operating state by superposing in 102 on the driver command. In this case, the negative lost torque value can be pregiven as the engine minimum torque so that, thereafter, in 116, the positive lost torque value is superposed. In this way, a desired torque is adjusted which avoids stalling as a consequence of the idle controller component or permits the making available of the wanted drag torque (for example, via injection suppression).

The determination of the engine minimum torque takes place preferably in 128 in dependence upon engine rpm NMOT and lost torque MVER. Different alternatives are present.

Figure 3:
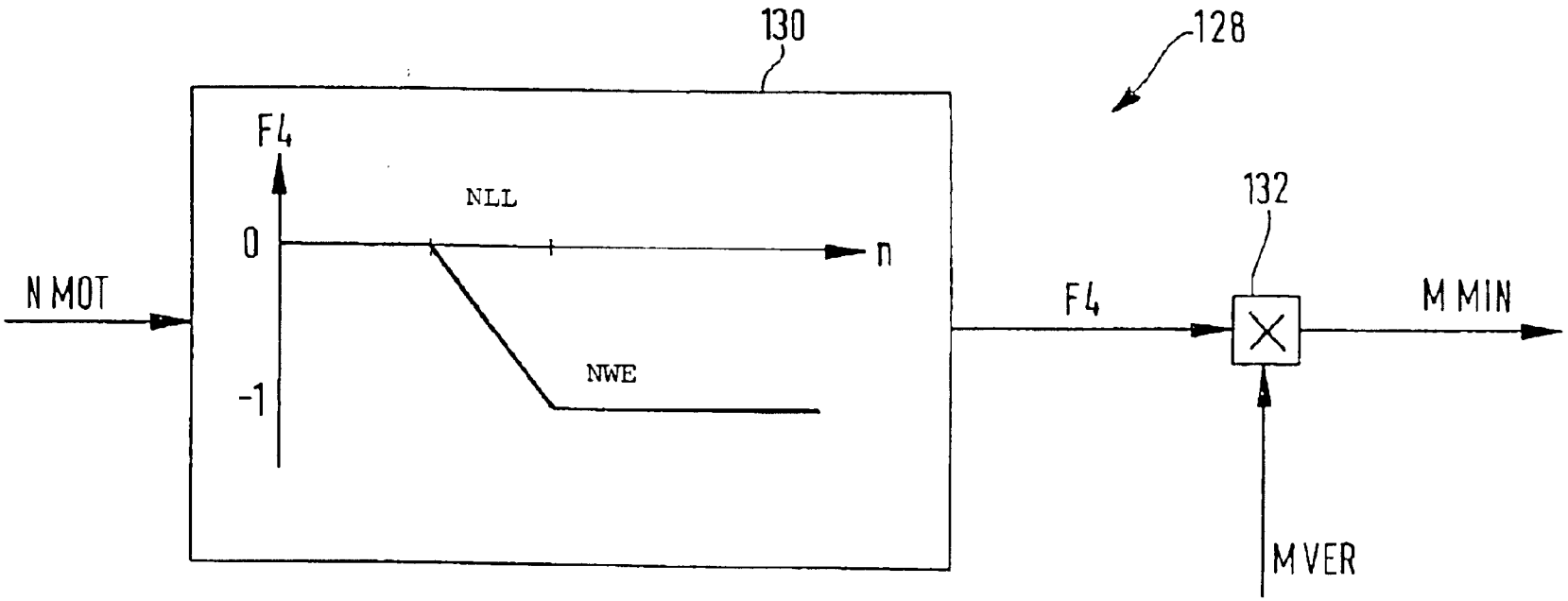
FIG. 3 shows a preferred embodiment for forming the motor minimum torque value.

A preferred alternative is shown in FIG. 3. There, a characteristic line 130 is shown in which a factor F4 is shown which moves between 0 and −1 in dependence upon the engine rpm. The factor is 0 up to idle rpm NLL. The factor is −1 starting from the resume rpm or the injection suppression rpm in overrun NWE. A characteristic line is provided between these two values, in the embodiment shown, a linear characteristic line is provided wherein the factor F4 changes from 0 to −1. The factor F4 formed in this way in dependence upon the engine rpm NMOT is logically coupled, preferably multiplied, by the lost torque MVER in a logic element 132. The lost torque MVER is formed in 120. The result is the minimum torque MMIN which is considered in the torque coordination. Accordingly, the factor F4 is 0 at low rpms below the idle rpm so that the torque 0 is pregiven as the minimum torque. In the overrun range, the factor is −1 so that the full negative lost torque is pregiven as the minimum torque. Therebetween, the minimum torque is a fraction of the lost torque so that a partial compensation of the negative loss torque takes place with the input of such a minimum torque by the subsequent superposition of the lost torque with the input of the minimum torque as resulting torque.

An alternative to the procedure shown in FIG. 3 comprises that the changing idle rpm and overrun suppression rpm is considered in the determination of the factor. In this case, no characteristic line is undertaken but a computation of the factor in which the instantaneous idle rpm and the instantaneous selected overrun suppression rpm is set.

A further alternative comprises the use of the rpm-dependent lower limit, which is present for the driver command, and which is superposed on the driver command as a corrective torque in 102. In the preferred embodiment, this corrective torque is rpm dependent and pedal position dependent and represents the torque value which should result when the pedal is released. If this torque value is utilized as engine minimum value, then dead travel is avoided at the pedal because the resulting torque cannot be less than the corrected torque.

Furthermore, in an embodiment for determining the factor F4, it is not the engine rpm which is used but rather a quantity which is normalized, for example, to the idle rpm. This is advantageous with the use of an operating-state dependent (normalized) rpm threshold for the protection against stalling or the idle control whose activation takes place when the (normalized) engine rpm drops below this rpm threshold.

In FIG. 2, the consideration of the engine minimum torque is shown in the torque coordination at the end of the coordination as maximum value selection stage. In another advantageous embodiment, and as an alternative hereto, the particular desired torque is coordinated individually with the minimum torque in the context of a maximum value selection ahead of each coordination block (108, 110, 112) so that limited torques are present already for the coordination and for the formation of the resulting desired torque.

In other embodiments, the minimum torque MMIN is pregiven as an absolute magnitude independently of the lost torque. In this case, the minimum limiting is not effective in the operating state overrun (internal torque zero).

What is claimed is:

1. A method for operating a drive motor of a vehicle, the method comprising the steps of:

determining an input quantity for a torque of the drive motor in dependence upon the driver command input quantity and at least one additional torque reducing input quantity;

logically coupling the driver command input quantity and the at least one additional input quantity to each other to form the resulting input quantity; and, inputting a motor minimum torque which limits the resulting input quantity to a lower limit value.

2. The method of claim 1, wherein the method comprises the further steps of: logically coupling the resulting input quantity with the motor minimum torque in the context of a maximum selection stage or logically coupling each input quantity individually, ahead of logically coupling with another input quantity, with the motor minimum torque in the context of a maximum value selection.

3. The method of claim 1, wherein the motor minimum torque is pregiven in dependence upon rpm.

4. The method of claim 1, wherein the motor minimum torque is dependent upon the motor lost torque, which represents the torque of the drive motor needed for overcoming the motor losses and/or for operating ancillary equipment.

5. The method of claim 1, wherein the motor minimum torque is zero in a first rpm range and, in a second rpm range, the motor minimum torque defines the negative value of the motor losses and, between these rpm ranges, an rpm-dependent change of the motor minimum torque occurs.

6. The method of claim 1, wherein the first rpm range is the range below the idle rpm and the second rpm range is the rpm range above an overrun suppression rpm.

7. The method of claim 1, wherein the motor minimum torque defines the torque which is pregiven as driver command torque for a released accelerator pedal.

8. An arrangement for operating a drive motor of a vehicle, the arrangement comprising:

an electronic control unit which inputs a resulting input quantity for a torque of the drive motor in dependence upon the driver command input quantity and at least one additional input quantity;

means for logically coupling the driver command input quantity and the at least one additional input quantity to form the resulting input quantity; and, said electronic control unit including means for inputting a motor minimum torque which limits the resulting input quantity to a lower limit.

9. A computer program comprising program code means for carrying out a method for operating a drive motor of a vehicle when run on a computer, the method including the steps of:

determining an input quantity for a torque of the drive motor in dependence upon the driver command input quantity and at least one additional torque reducing input quantity;

logically coupling the driver command input quantity and the at least one additional input quantity to each other to form the resulting input quantity; and, inputting a motor minimum torque which limits the resulting input quantity to a lower limit value.

10. A computer program product comprising program code means which are stored on a computer readable data carrier for carrying out a method for operating a drive motor of a vehicle when the program product is executed on a computer, the method including the steps of:

determining an input quantity for a torque of the drive motor in dependence upon the driver command input quantity and at least one additional torque reducing input quantity;

logically coupling the driver command input quantity and the at least one additional input quantity to each other to form the resulting input quantity; and, inputting a motor minimum torque which limits the resulting input quantity to a lower limit value.

* * * * *